US010753623B2

(12) United States Patent
Harris

(10) Patent No.: US 10,753,623 B2
(45) Date of Patent: Aug. 25, 2020

(54) FLAME CONTROL SYSTEMS AND METHODS FOR FURNACES

(71) Applicant: Johnson Controls Technology Company, Auburn Hills, MI (US)

(72) Inventor: William M. Harris, Norman, OK (US)

(73) Assignee: Johnson Controls Technology Company, Auburn Hills, MI (US)

( * ) Notice: Subject to any disclaimer, the term of this patent is extended or adjusted under 35 U.S.C. 154(b) by 93 days.

(21) Appl. No.: 16/052,271

(22) Filed: Aug. 1, 2018

(65) Prior Publication Data

US 2019/0249882 A1 Aug. 15, 2019

Related U.S. Application Data

(60) Provisional application No. 62/631,369, filed on Feb. 15, 2018.

(51) Int. Cl.

| | |
|---|---|
| ***F24D 19/10*** | (2006.01) |
| ***F23N 1/00*** | (2006.01) |
| ***F23N 5/20*** | (2006.01) |
| ***F24D 5/04*** | (2006.01) |
| ***F23N 5/24*** | (2006.01) |
| ***F23N 1/04*** | (2006.01) |

(52) U.S. Cl.

CPC ..... *F24D 19/1084* (2013.01); *F23N 1/002* (2013.01); *F23N 1/042* (2013.01); *F23N 5/203* (2013.01); *F23N 5/242* (2013.01); *F24D 5/04* (2013.01); *F23N 2227/02* (2020.01); *F23N 2233/10* (2020.01); *F23N 2241/02* (2020.01)

(58) Field of Classification Search

CPC ..... F24D 19/1084; F24D 5/04; F23N 5/242; F23N 1/042; F23N 1/002; F23N 5/203

See application file for complete search history.

(56) References Cited

U.S. PATENT DOCUMENTS

| | | | | |
|---|---|---|---|---|
| 4,251,025 | A * | 2/1981 | Bonne | F23N 1/065 236/14 |
| 5,524,556 | A * | 6/1996 | Rowlette | F23N 1/06 110/162 |
| 7,455,238 | B2 * | 11/2008 | Hugghins | F23N 5/022 236/15 R |
| 9,291,355 | B2 | 3/2016 | Hugghins | |
| 9,453,648 | B2 | 9/2016 | Schultz et al. | |
| 9,765,965 | B2 | 9/2017 | Kowald et al. | |
| 2014/0150445 | A1 * | 6/2014 | Huntington | F23R 3/28 60/776 |
| 2017/0176048 | A1 * | 6/2017 | Schneider | F24D 5/02 |

* cited by examiner

*Primary Examiner* — David J Laux

(74) *Attorney, Agent, or Firm* — Fletcher Yoder, P.C.

(57) ABSTRACT

A furnace includes a controller configured to instruct a blower of the furnace to increase an exhaust flowrate of the furnace, instruct a gas regulation device of the furnace to increase a fuel input rate of the furnace, or both in response to a determination that the fuel input rate is below a threshold fuel input rate for a threshold time period. In some embodiments, the controller is configured to instruct the blower to maintain an increased exhaust flowrate for a flame-stabilizing time period the gas regulation device to maintain an increased fuel input rate for the flame-stabilizing time period, or both.

27 Claims, 7 Drawing Sheets

FLAME CONTROL SYSTEMS AND METHODS FOR FURNACES

CROSS REFERENCE TO RELATED APPLICATIONS

This application claims priority from and the benefit of U.S. Provisional Application Ser. No. 62/631,369, entitled "FLAME CONTROL SYSTEMS AND METHODS FOR FURNACES," filed Feb. 15, 2018, which is hereby incorporated by reference.

BACKGROUND

The present disclosure relates generally to heating, ventilating, and air conditioning (HVAC) systems, and more particularly, to flame control systems for furnaces of HVAC systems.

Residential, light commercial, commercial, and industrial systems are used to control temperatures and air quality in buildings. Such systems may be dedicated to heating or cooling, although systems are common that perform both of these functions. Generally, these systems operate by circulating a refrigerant through a closed circuit between an evaporator where the refrigerant absorbs heat and a condenser where the refrigerant releases heat. The refrigerant flowing within the closed circuit is generally formulated to undergo phase changes within the normal operating temperatures and pressures of the systems so that quantities of heat can be exchanged by virtue of the latent heat of vaporization of the refrigerant to provide conditioned air to the buildings.

Additionally, many HVAC systems include furnaces. For example, a HVAC system may include a furnace with a burner assembly and a heat exchanger to produce heated air for conditioning an interior space of a building. Generally, the furnace operates by burning or combusting a mixture of air and fuel in the burner assembly to produce combustion products, which may pass through the heat exchanger to transfer heat to air passing over the heat exchanger. Thus, the heated air may travel from the furnace to the interior space of the building. However, in some embodiments, flames of the burner assembly may recess or flash back into the burners of the flame assembly, thereby producing soot and reducing an efficiency of the furnace. Accordingly, improved flame control systems for furnaces are desired.

SUMMARY

In one embodiment of the present disclosure, a furnace includes a controller configured to instruct a blower of the furnace to increase an exhaust flowrate of the furnace, instruct a gas regulation device of the furnace to increase a fuel input rate of the furnace, or both in response to a determination that the fuel input rate is below a threshold fuel input rate for a threshold time period.

In another embodiment of the present disclosure, a furnace includes a gas regulation device configured to adjust a fuel input rate of the furnace and a blower configured to adjust an exhaust flowrate of the furnace. The furnace also includes a controller communicatively coupled to the gas regulation device and the blower. The controller is configured to separately instruct the gas regulation device and the blower to adjust the fuel input rate and the exhaust flowrate, respectively, in response to a determination that the fuel input rate of the furnace is below a threshold fuel input rate for a threshold time period.

In a further embodiment of the present disclosure, a method of operating a flame control system for a furnace includes monitoring a fuel rate of the furnace. The method includes adjusting the fuel rate to a flame-stabilizing fuel rate.

Other features and advantages of the present application will be apparent from the following, more detailed description of the embodiments, taken in conjunction with the accompanying drawings which illustrate, by way of example, the principles of the application.

DETAILED DESCRIPTION

Figure 1:
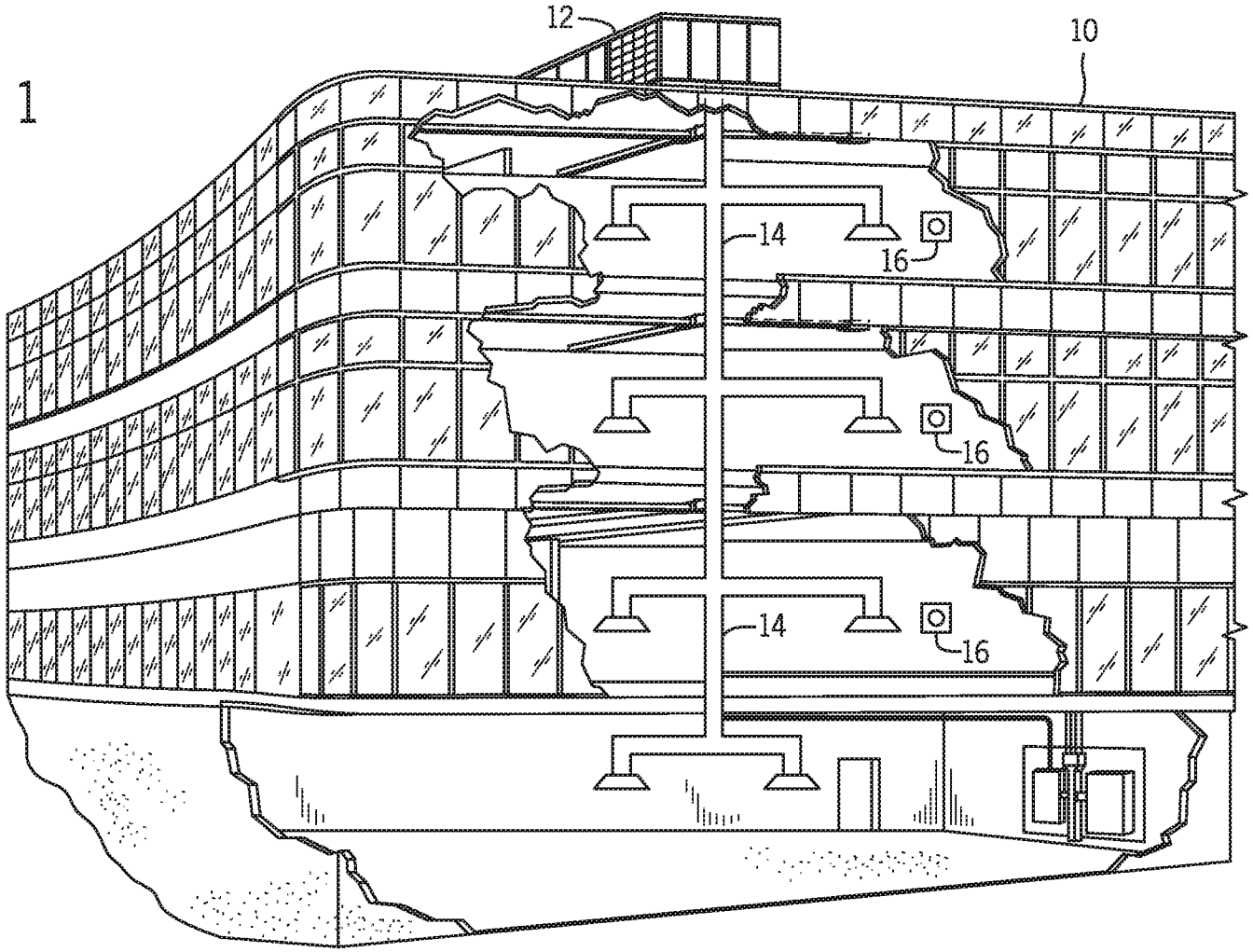
FIG. 1 is an illustration of an embodiment of a commercial or industrial HVAC system, in accordance with present techniques.

The present disclosure is directed to flame control systems and methods for furnace systems. As noted above, a furnace system combusts a fuel via a flame of a burner to provide hot exhaust gas. The hot exhaust gas is drawn through a heat exchanger by a draft inducer blower and transfers heat to air provided to warm an interior space of a building. During a startup mode of the furnace system, a full or maximum fuel input rate to the burner may be provided by a modulating gas valve or gas regulation system, and a full or maximum exhaust flowrate may be generated by the draft inducer blower. As such, an igniter may provide activation energy to the burner, which generates a robust flame outside of a body of the burner. However, under certain conditions, such as high wind conditions and/or low or turned down furnace operation, the flame of the burner may move or flash back into the body of the burner. The flashed back flame may allow fuel to pass through the burner without being fully combusted and/or may form soot within the burner, thus reducing an efficiency of the furnace system. To mitigate flame flashback, certain traditional furnace systems may employ complex and expensive sensor feedback systems to determine whether the flame is recessed within a body of a burner of the traditional furnace systems. Additionally, some traditional furnace systems may only correct flashed back flames incidentally when starting or restarting the traditional furnace systems.

With the foregoing in mind, present embodiments are directed to a flame control system that maintains or reestablishes robust flames outside the body of each burner of a burner assembly. As used herein, a "robust" flame refers to a flame that exists outside of the body or tube of the burner, and therefore is not "flashed back" into the body of the burner. Indeed, a main cause of flame flashback may be a low flowrate or pressure of fuel provided through the burner, as flame flashback can be indicative of a flame that burns fuel at a faster rate than it is received. As such, the flame control system may include a controller having an operating cycle that periodically reinvigorates the flame by increasing movement of the fuel and air near the burners, without dependence on costly sensors. For example, a controller of the flame control system may monitor a fuel input rate provided to the burner assembly over time, compare the fuel input rate to a threshold fuel input rate, and initiate control actions in response to determining that the fuel input rate is below the threshold fuel input rate for a threshold time period. In some embodiments, the control actions include instructing the modulating gas valve to increase the fuel input rate provided to the burner assembly, instructing the draft inducer blower to increase an exhaust flowrate through the furnace system, or both. As such, the flame control system maintains and/or reestablishes robust flames for each burner of the burner assembly via an open loop control algorithm to improve an operating efficiency of the furnace system. These and other features will be described in detail below with reference to the drawings herein.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes a HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
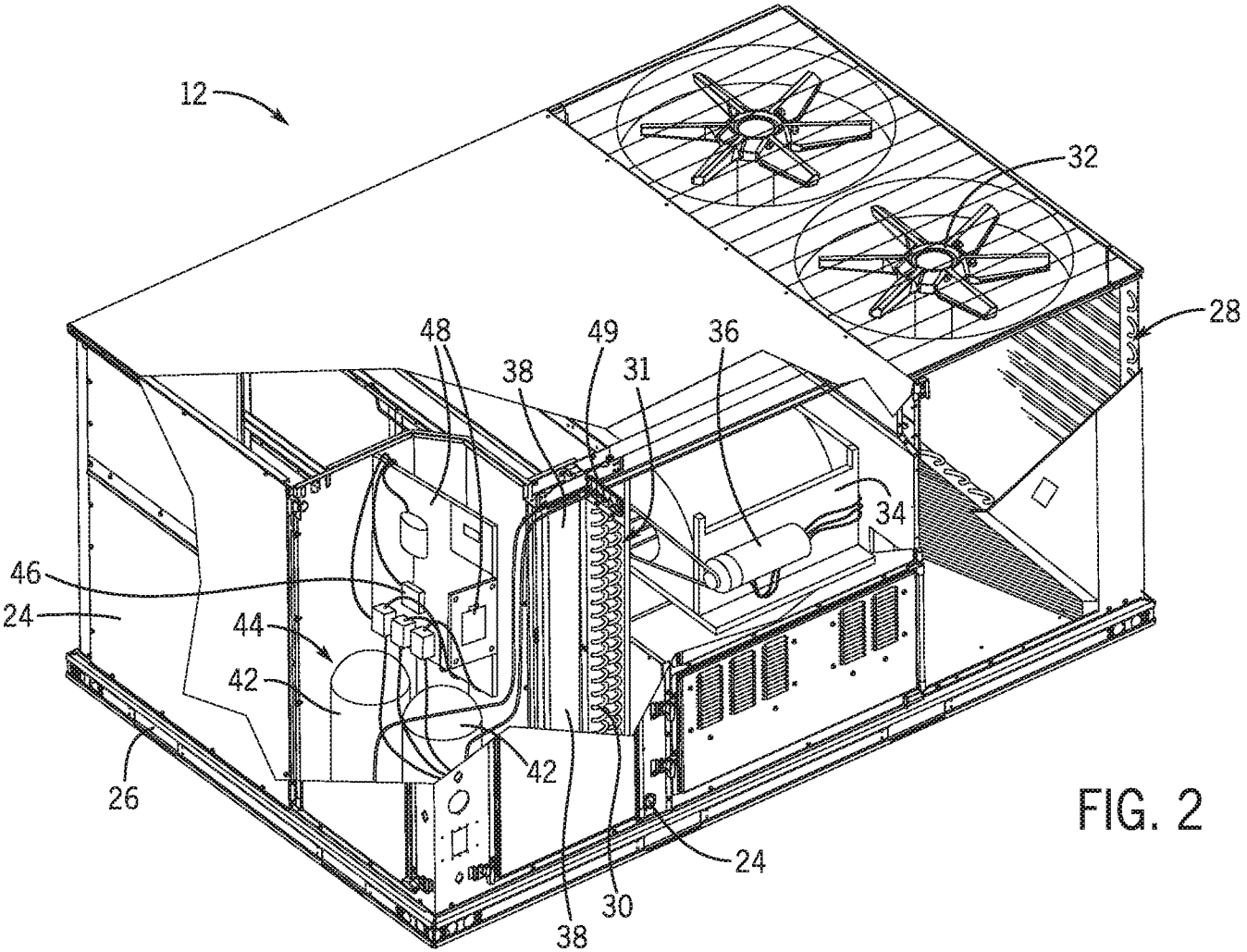
FIG. 2 is an illustration of an embodiment of a packaged unit of the HVAC system, in accordance with present techniques.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant through the heat exchangers 28 and 30. For example, the refrigerant may be R-410A. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
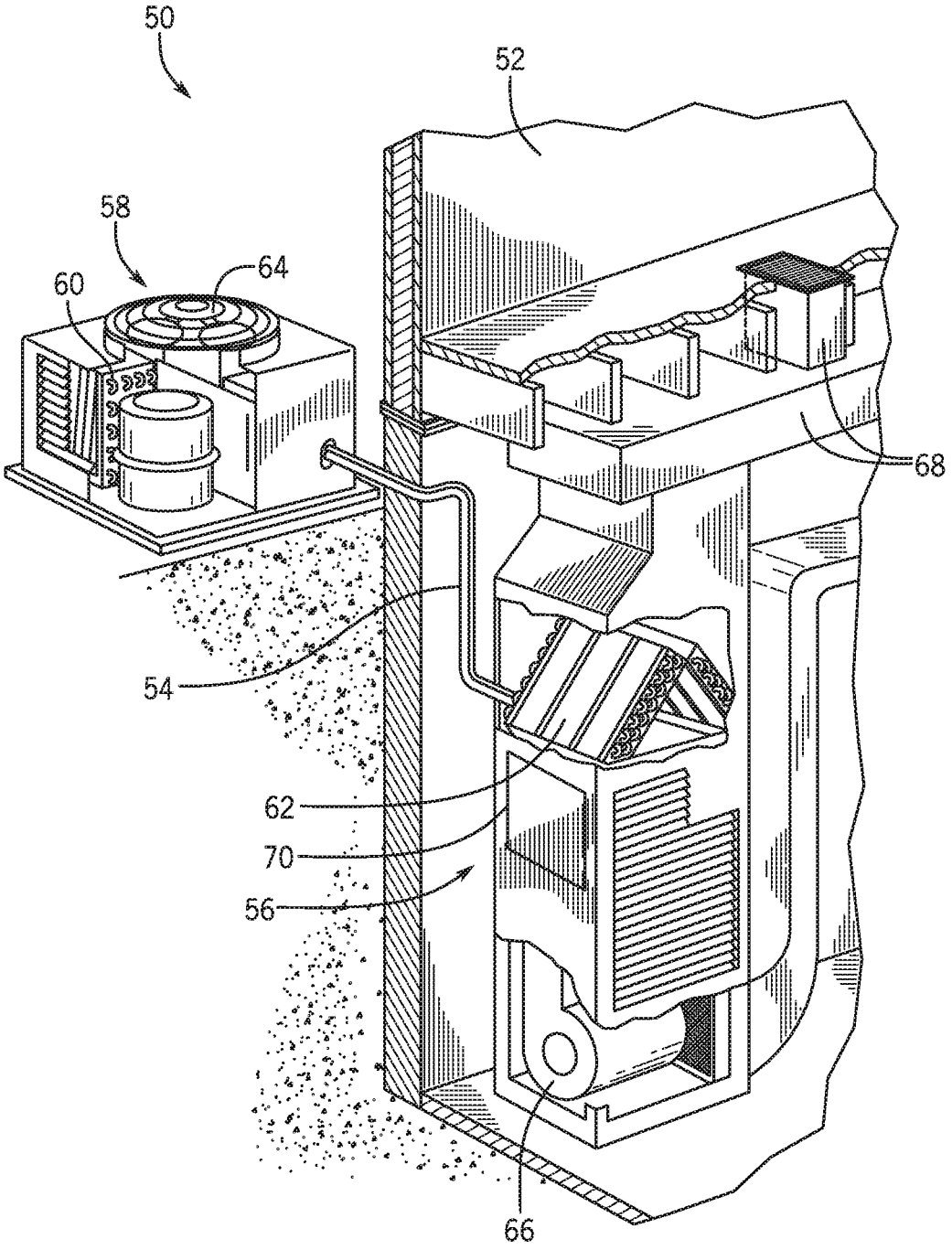
FIG. 3 is an illustration of an embodiment of a split system of the HVAC system, in accordance with present techniques.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger that is separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
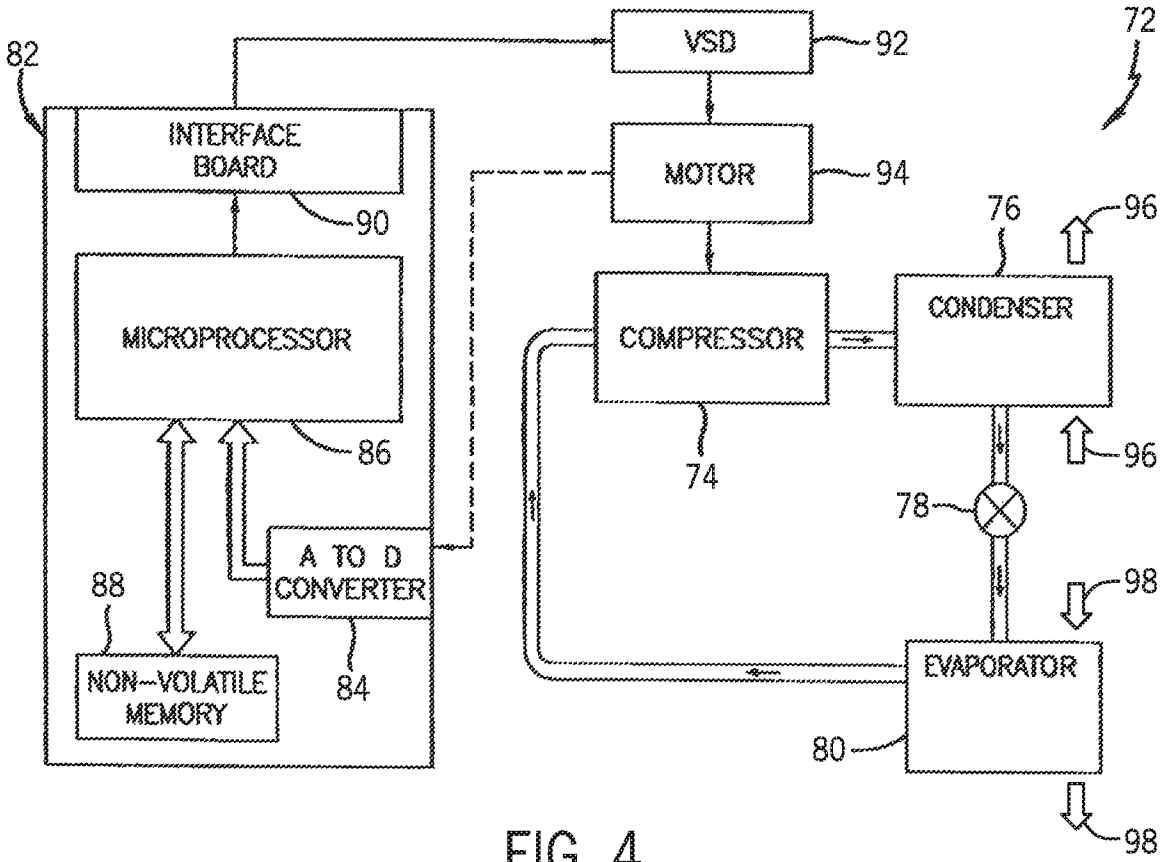
FIG. 4 is a schematic diagram of an embodiment of a refrigeration system of the HVAC system, in accordance with present techniques.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Moreover, in accordance with present techniques, a flame control system may be incorporated in any of the HVAC systems or furnace systems illustrated in FIGS. 1-4. For example, the flame control system may control flames of the furnace of the HVAC unit 12 of FIG. 2, the furnace system 70 of the residential heating and cooling system 50 of FIG. 3, or any other suitable furnace system employing flames. As discussed herein, the flame control system operates to maintain and/or reestablish robust flames within burners of the furnace system. It is to be understood that robust flames are flames which are positioned outside of bodies of the burners, and thus are not flashed back into the burners. Thus, the flame control system may reduce or eliminate flame flashback to improve an efficiency of the furnace system. The flame control system will be described in greater detail below with reference to FIGS. 5-8.

Figure 5:
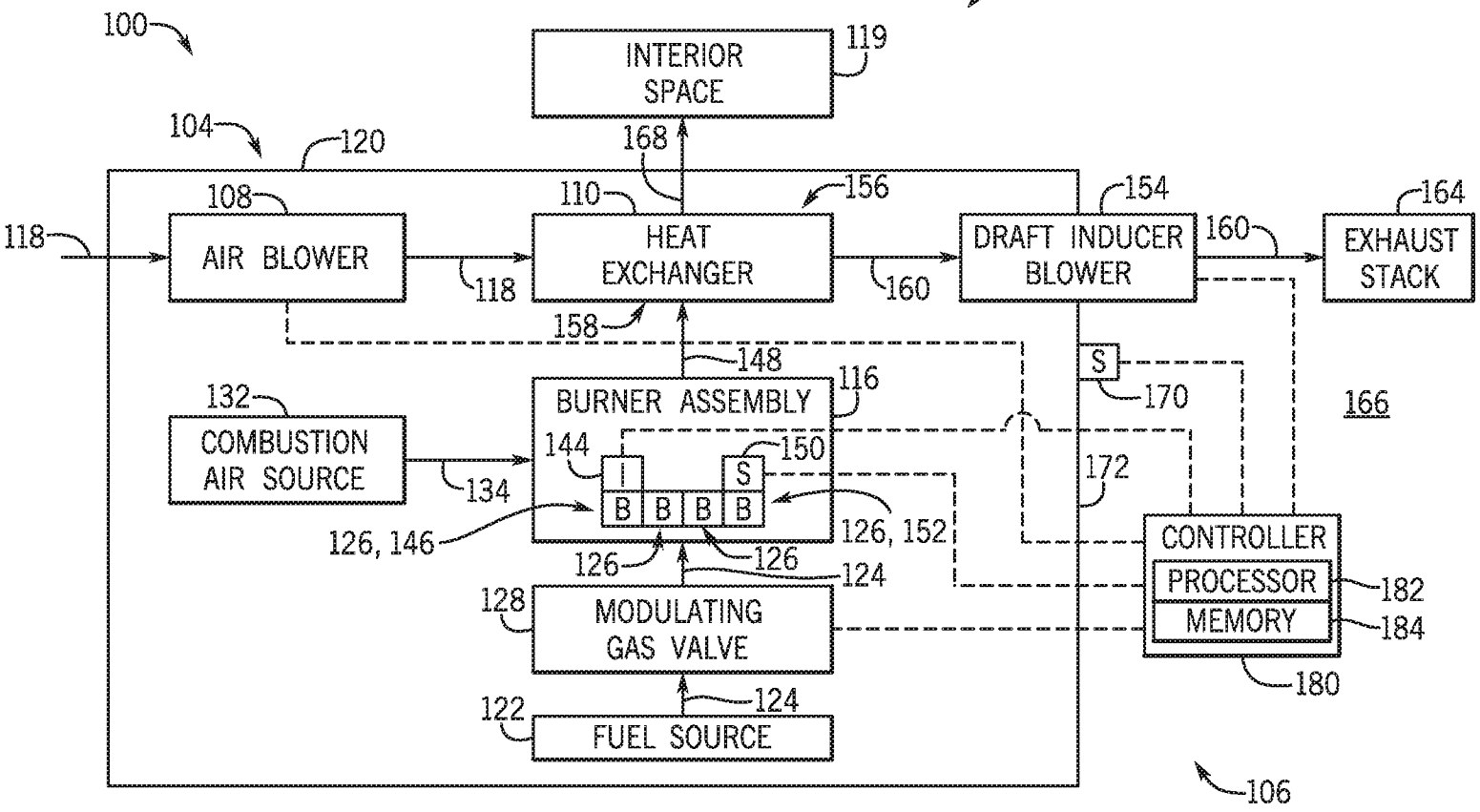
FIG. 5 is a schematic diagram of an embodiment of a flame control system of a furnace system, in accordance with present techniques.

FIG. 5 is a schematic diagram of a HVAC system 100 having a furnace system 104 and a flame control system 106 operatively coupled to the furnace system 104. The flame control system 106 is capable of controlling components of the furnace system 104 to maintain robust flames therein. The furnace system 104 also includes an air blower 108, a heat exchanger 110, and a burner assembly 116 that operate together to heat air 118 for conditioning an interior space 119 of the building 10. As illustrated, one or more components of the furnace system 104 may be disposed within an enclosure 120 to enable the air 118 to be directed over the heat exchanger 110. However, in some embodiments, the heat exchanger 110, the burner assembly 116, and other components of the furnace system 104 may be housed in separate enclosures, separate portions of the enclosure 120, or in a shared portion of the enclosure 120. Moreover, although discussed herein as having one heat exchanger 110, any suitable number and configuration of heat exchangers, including primary and secondary heat exchangers of a condensing furnace system, may be used within the furnace system 104 for transferring heat to the air 118.

As shown, the furnace system 104 includes a fuel source 122 to provide a fuel 124 to burners 126 of the burner assembly 116. The fuel 124 may include natural gas, liquefied petroleum gas, fuel oil, coal, or the like. The burners 126 burn the fuel 124 to generate thermal energy for the heat exchanger 110 to transfer to the air 118, as discussed in more detail below. The burners 126 may be any suitable body, nozzle, or tube having an inlet for receiving the fuel 124 and an outlet for directing the fuel 124 therefrom. As illustrated, a modulating gas valve 128 or gas regulation device is fluidly coupled between the fuel source 122 and the burner assembly 116 to regulate a fuel input rate of the fuel 124 provided to the burners 126 of the burner assembly 116. Although described herein with reference to the modulating gas valve 128, it is to be understood that the furnace system 104 may additionally or alternatively include any suitable gas regulation device or system, such as a pressure regulator. Additionally, in some embodiments, an oxidant or combustion air source 132 may provide combustion air 134 or some other oxidant to the burners 126 of the burner assembly 116. For example, combustion air 134 may be drawn into each individual burner 126 of the burner assembly 116 to mix with the fuel 124 drawn into each individual burner 126 of the burner assembly 116. In some embodiments, the combustion air source 132 may be an area within the burner assembly 116 external to the individual burners 126 of the burner assembly 116.

In some embodiments, the combustion air 134 may mix with the fuel 124 in the burners 126 to form a combustible mixture, which may be referred to herein as the mixture. The mixture may be ignited via an igniter 144 coupled to the burner assembly 116. A pulse may be sent through the igniter 144 to instruct the igniter 144 to produce a spark adjacent to or within the burners 126 of the burner assembly 116. In some embodiments, the mixture is ignited in one ignitable burner 146 proximate the igniter 144, which sequentially ignites the mixture in adjacent burners 126. In other embodiments, the mixture may be ignited by other means, such as a hot surface igniter or a pilot light flame. In the illustrated embodiment, once ignited, the mixture drawn through the burners 126 of the burner assembly 116 may burn and form combustion products, such as a hot exhaust gas 148. By maintaining robust flames, such as flames outside of bodies of the burners 126, the burners 126 may produce the hot exhaust gas 148 at a desired temperature, composition, and/or efficiency.

Further, the flame control system 106 may include a flame sensor 150 coupled to the burner assembly 116 to sense a presence of a flame on a sensed burner 152, opposed from the ignitable burner 146. As such, the flame sensor 150 enables the flame control system 106 to verify whether the mixture within each of the burners 126 has been ignited. However, the flame sensor 150 may continue to detect a flame from the sensed burner 152 even if the flame is flashed back, as the flashed back flame may continue to develop sufficient heat for the flame sensor 150 to detect. Additionally, because each burner 126 may not have a flame sensor 150 attached thereto, as illustrated, the flame control system 106 may not detect the presence of the flame for each burner 126. As such, it is desirable to maintain robust flames for each burner 126 without dependence on sensor feedback.

The furnace system 104 also includes a draft inducer blower 154 fluidly coupled to a distal portion 156 of the heat exchanger 110, opposite a proximal portion 158 of the heat exchanger 110 that is proximate the burner assembly 116. In certain embodiments, the combustion air 134 may be drawn into the burners 126 of the burner assembly 116 at least partially due to a pressure difference generated by the draft inducer blower 154, which may also be responsible for drawing the hot exhaust gas 148 through the heat exchanger 110. In other words, a flow path may exist between the burners 126 of the burner assembly 116 and the draft inducer blower 154, such that the draft inducer blower 154 assists in both pulling the combustion air 134 into the burners 126 of the burner assembly 116 and pulling the hot exhaust gas 148 through the flow path between the draft inducer blower 154 and the burner assembly 116. Additionally, as the draft inducer blower 154 pulls the hot exhaust gas 148 through the heat exchanger 110, the hot exhaust gas 148 cools into exhaust gas 160, which the draft inducer blower 154 may direct into an exhaust stack 164 of the furnace system 104. Thus, the exhaust stack 164 may export the exhaust gas 160 from the furnace system 104 into an external environment 166 external to the furnace system 104.

Moreover, during operation of the furnace system 104, as the hot exhaust gas 148 is drawn through the heat exchanger 110, the air blower 108 draws the air 118 into the enclosure 120 of the furnace system 104. Then, the air 118 may pass over coils of the heat exchanger 110 to absorb thermal energy from the hot exhaust gas 148 flowing therein, thus generating heated air 168. Then, the heated air 168 is released from the enclosure 120 and provided into an air distribution system of the building 10, such as the ducts 14 of FIG. 1, for conditioning the interior space 119 of the building 10.

Further, in embodiments in which the enclosure 120 of the furnace system 104 is disposed outside of the building 10, wind conditions may increase a sensitivity of the burner assembly 116 to flame flashback. As such, the present flame control system 106 may include a wind sensor 170 coupled to an external surface 172 of the enclosure 120 or fluidly coupled to the external environment 166. The wind sensor 170 may be a pressure switch or any other suitable sensor for monitoring a presence of a wind condition and/or a wind speed, and transmitting sensor signals indicative of the wind condition and/or the wind speed to the flame control system 106. As such, the flame control system 106 may adjust control parameters based on detection of the wind condition, as discussed in more detail with reference to FIG. 8 below.

Additionally, the illustrated furnace system 104 is a variable speed or modulating furnace system capable of continuously adjusting the amount and temperature of the heated air 168 provided to the building 10. As such, based on a heat demand for the interior space 119 of the building, the furnace system 104 may adjust the fuel input rate of the fuel 124 provided to the burners to directly modify the heat developed within the hot exhaust gas 148. Additionally, in some embodiments, an exhaust flowrate generated by the draft inducer blower 154 is simultaneously controlled with the fuel input rate to modify the flowrate of the hot exhaust gas 148 through the heat exchanger 110. However, the furnace system 104 may alternatively be a two stage or multiple stage furnace system capable of operating at two or more different heat output levels or capacities, such as a low heat output level and a high heat output level.

The flame control system 106 may include a controller 180 to control the furnace system 104 by transmitting control signals to various components therein. For example, the controller 180 may be communicatively coupled to the modulating gas valve 128 and the draft inducer blower 154. As such, the controller 180 may instruct the modulating gas valve 128 to adjust a fuel input rate of the fuel 124 provided to the burner assembly 116, thus directly affecting a temperature of the hot exhaust gas 148 produced by the burner assembly 116. That is, increasing the fuel input rate into the burner assembly 116 increases the temperature of the hot exhaust gas 148 and increases the temperature of the heated air 168, and vice versa. Additionally, the controller 180 may instruct the draft inducer blower 154 to generate an increased exhaust flowrate through the heat exchanger 110 in response to the increased fuel input rate to modify the negative pressure applied to the burner assembly 116 and to modify the flowrate of the hot exhaust gas 148 through the heat exchanger 110. As such, increasing the fuel input rate and the speed of the draft inducer blower 154 is referred to hereinafter as ramping up the furnace system 104 to increase an amount of heat provided to the interior space 119 of the building 10, while decreasing the fuel input rate and decreasing the speed of the draft inducer blower 154 is hereinafter referred to as ramping down the furnace system 104 to reduce an amount of heat provided to the interior space 119 of the building 10. Further, in some embodiments, the controller 180 is communicatively coupled to the air blower 108, and transmits control signals to cause the air blower 108 to modify an air flowrate across coils of the heat exchanger 110, thus modifying the amount of time the air 118 is in contact with the heat exchanger 110 while ramping up or ramping down the furnace system 104.

As discussed herein, the flame control system 106 is included in the furnace system 104 to maintain robust flames outside of the bodies of the burners 126 of the burner assembly 116. Indeed, blocking the flames of the burners 126 from flashing back into the bodies of the burners 126 improves an efficiency of the furnace system 104 by enabling the furnace system 104 to operate with more complete combustion, thus reducing or minimize fuel bypass through the burners 126. Indeed, in conditions in which the flames flashback into the bodies of the burners 126, excess soot and/or reduced thermal energy may be generated. To maintain robust flames that are not flashed back into the burners, the controller 180 may therefore adjust various flow control devices of the furnace system, including the modulating gas valve 128, and/or the draft inducer blower 154.

The controller 180 may maintain the robust flames by monitoring a fuel input rate of the furnace system 104. For example, the controller 180 may store data indicative of the fuel input rate of the furnace system 104 over time. The controller 180 may also monitor the exhaust flowrate produced by the draft inducer blower 154 over time, and store data indicative of the exhaust flowrate over time. In response to determining that the fuel input rate is below a threshold fuel input rate for a threshold time period, the controller 180 may perform a suitable control action to mitigate or prevent flame flashback. Further, although discussed herein as controlling the flames in response to monitoring the fuel input rate, it is to be understood that other suitable parameters, such as the exhaust flowrate generated by the draft inducer blower 154, may additionally or alternatively be monitored to determine when to perform the suitable control action.

For example, as the suitable control action, the controller 180 may instruct the modulating gas valve 128 to increase the fuel input rate through the burner assembly 116 to a flame-stabilizing fuel input rate and/or instruct the draft inducer blower 154 to increase the exhaust flowrate to a flame-stabilizing exhaust flowrate. Thus, the flame control system 106 can control the flames to be on the surface of the burners 126, with more reliability than dependence on the flame sensor 150 alone. As such, the present flame control system 106 can be installed as a software solution to mitigate flame flashback by fully or partially ramping the furnace system 104 to an increased operating point. Moreover, the flame control system 106 may maintain the flames at the increased operating point for a flame-stabilizing threshold time period, such that the flame is maintained or reestablished, while excess heat may not be developed. In certain embodiments, the flame control system ramps up the draft inducer blower 154 in response to determining that the furnace system is below the threshold fuel input rate for the threshold time period, such that more thermal energy is not generated within the furnace system 104, while the flame is still desirably maintained robust. As such, the controller 180 discussed herein may include a distributed control system (DCS) or any computer-based control system that is fully or partially automated. For example, the controller 180 may be any device employing a general purpose or an application-specific processor 182 and memory circuitry 184 storing instructions related to furnace and flame control.

Figure 6:
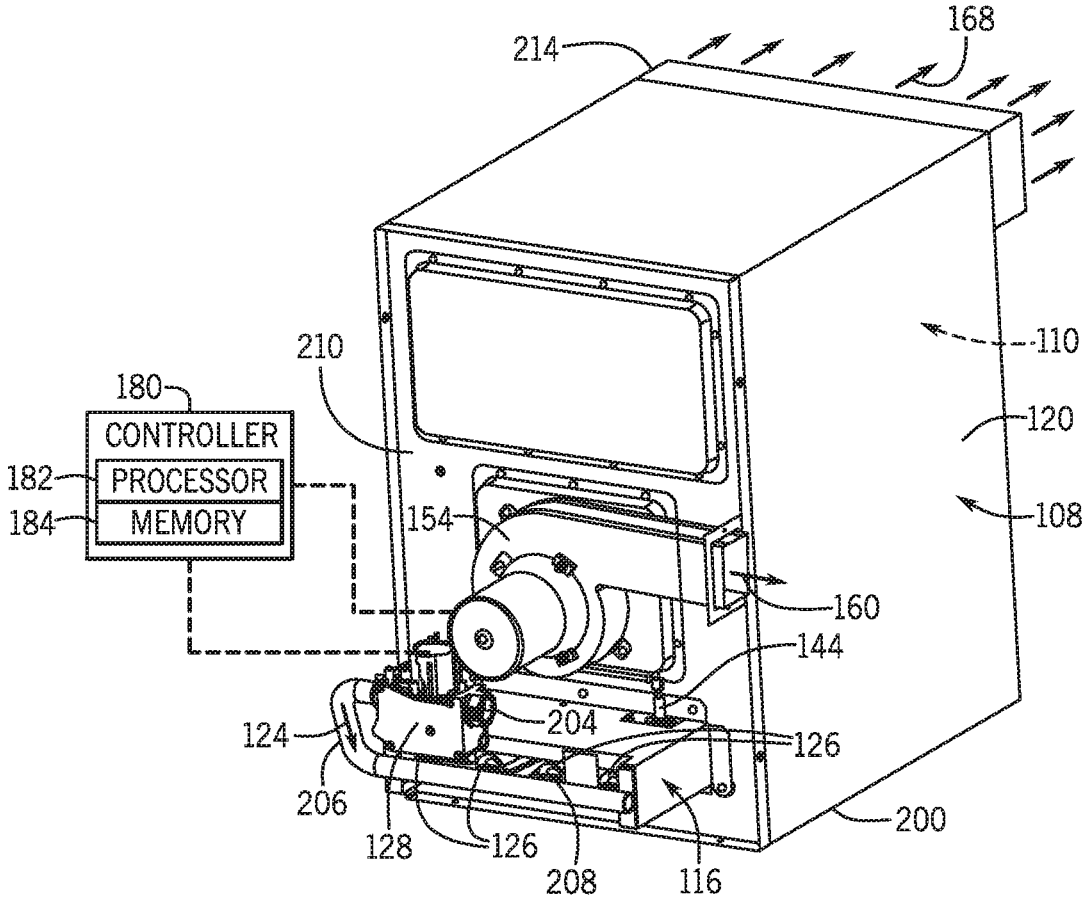
FIG. 6 is a perspective view of an embodiment of the furnace system of FIG. 5 having the flame control system, in accordance with present techniques.

FIG. 6 is a perspective view of an embodiment of the furnace system 104 having the flame control system 106. In the illustrated embodiment, the burner assembly 116 is located near a bottom surface 200 of the furnace system 104, and the four burners 126 are illustrated within the burner assembly 116. As previously described, each burner 126 is capable of combusting a mixture of combustion air 134 and fuel 124. The combustion air 134 may be drawn into each burner 126 partially due to a pressure difference generated by the draft inducer blower 154, as well as partially due to air entrainment within the gas jet provided to each burner 126 of the burner assembly 116. Additionally, the fuel 124 is provided from the fuel source 122 of FIG. 1 through a gas inlet 204 of the modulating gas valve 128. The modulating gas valve 128 is coupled to a manifold 206, which distributes the fuel 124 to a body 208 of each burner 126. In some embodiments, the fuel 124 may be distributed via the manifold 206 to each burner 126 evenly. As such, the modulating gas valve 128 may control the fuel input rate to the burners 126, such that the modulating gas valve 128 controls a quantity or volume of the fuel 124 in the mixture of each burner 126.

Moreover, the draft inducer blower 154 is disposed on an outer surface 210 of the enclosure 120 of the furnace system 104. As previously described, the draft inducer blower 154 draws the hot exhaust gas 148 produced at the burners 126 through the heat exchanger 110 within the enclosure 120. Additionally, the air blower 108 may be disposed within the enclosure 120 near the bottom surface 200 of the enclosure 120, and may blow the air 118 over tubes of the heat exchanger 110, such that the air 118 extracts heat from the hot exhaust gas 148. Thus, the heated air 168 is provided through a duct 214 and to the interior space 119. Additionally, the exhaust gas 160 may be pulled through and blown from the tubes of the heat exchanger 110 into the exhaust stack 164. Thus, the controller 180 communicatively coupled to the modulating gas valve 128 and the draft inducer blower 154 may adjust operation of the modulating gas valve 128 and/or the draft inducer blower 154 to maintain robust flames outside of the bodies 208 of the burners 126 according to the methods discussed below with reference to FIGS. 7 and 8.

Figure 7:
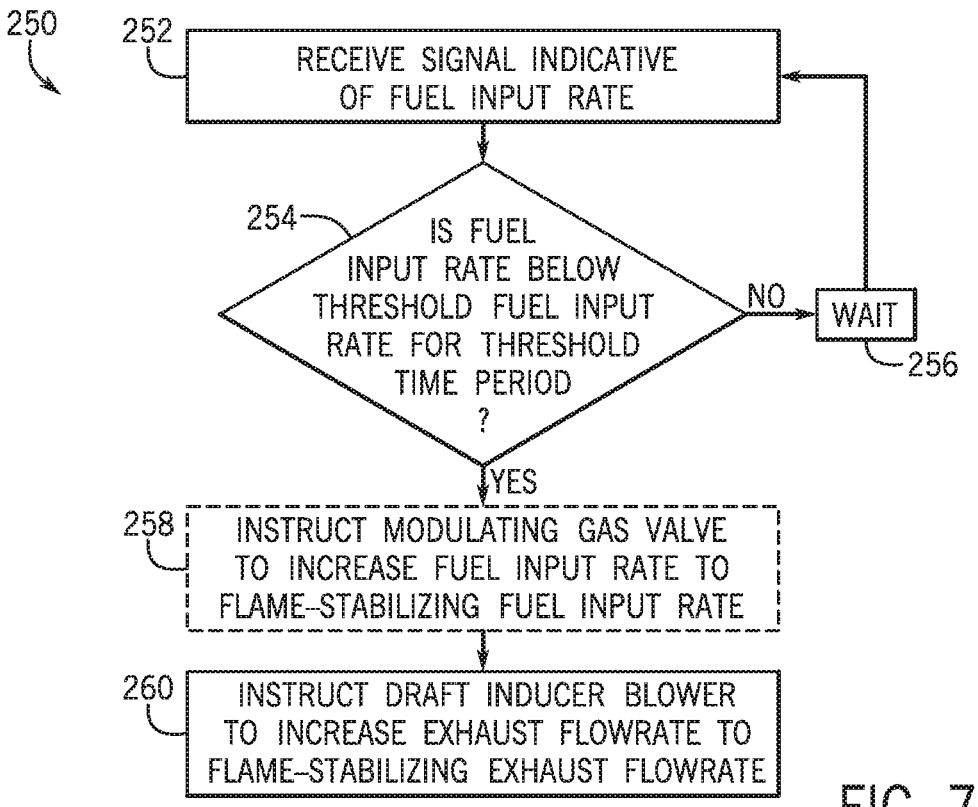
FIG. 7 is a flow chart of an embodiment of a method for operating the flame control system of FIG. 5, in accordance with present techniques.

FIG. 7 is a flow chart of an embodiment of a method 250 for operating the flame control system 106 to maintain robust flames of the furnace system 104. The method 250 of FIG. 7 is described with reference to the elements of FIGS. 1-6. One or more steps of the method 250 may be performed simultaneously or in a different sequence from the sequence in FIG. 7. The method 250 may be performed by the controller 180 of the flame control system 106 or by another suitable controller communicatively coupled to the flame control system 106 of the furnace system 104. First, as indicated by block 252, the controller 180 receives a signal indicative of the fuel input rate provided to the burner assembly 116. For example, the controller 180 may receive signals from the modulating gas valve 128. The modulating gas valve 128 may transmit signals to the controller 180 upon request by the control panel 82, continuously, at regular intervals, every minute, every ten minutes, or the like. Then, based on the signals, the controller 180 may determine the fuel input rate provided to the burner assembly 116 over time. However, in some embodiments, the controller 180 may monitor and/or analyze a log of control signals the controller 180 has previously provided to the modulating gas valve 128 to determine the fuel input rate over time.

As indicated by block 254, the controller 180 may next determine whether the fuel input rate is below a threshold fuel input rate for a threshold time period. The threshold fuel input rate may be any suitable fuel input rate below which flames of the burner assembly 116 may diminish in strength and/or flash back into the bodies 208 of the burners 126. The threshold fuel input rate may be a user-set, technician-set, or distributor-set value that is stored within the controller 180 either before or after the controller 180 is placed into operation within the flame control system 106. For example, in the present embodiment in which the furnace system 104 is a modulating furnace system, the threshold fuel input rate may be set as 80 percent, 70 percent, 60 percent, 50 percent, 40 percent, 30 percent, 20 percent, and so forth, of a maximum fuel input rate for the furnace system 104. Additionally, in some embodiments in which the furnace system 104 is a two stage furnace system, the threshold fuel input rate may be set as the fuel input rate of the lower or reduced heat output level of the two stage furnace. As such, by setting or adjusting the threshold fuel input rate and monitoring when the fuel input rate provided by the modulating gas valve 128 is below the threshold fuel input rate, the flame control system 106 operates to maintain robust flames within the furnace system 104.

Moreover, in response to determining that the fuel input rate is not below the threshold fuel input rate for the threshold time period, the controller 180 may proceed to wait a predefined amount of time, as indicated in block 256. Thus, the controller 180 may continue to receive signals indicative of the fuel input rate, as indicated in block 252, and the furnace system 104 may continue to operate to provide the heated air 168 to the interior space 119 of the building 10.

Alternatively, in response to determining that the fuel input rate is below the threshold fuel input rate for the threshold time period, the controller 180 may optionally instruct the modulating gas valve 128 to increase the fuel input rate to a flame-stabilizing fuel input rate, as indicated by block 258. The flame-stabilizing fuel input rate may be a controller-stored value indicative of a fuel input rate that maintains or generates robust flames within the burners 126 of the burner assembly 116. For example, the flame-stabilizing fuel input rate may be set as at least 40 percent, 50 percent, 60 percent, 70 percent, 80 percent, 90 percent, 100 percent, and so forth of the maximum fuel input rate for the furnace system 104. As such, increasing or ramping the fuel input rate to the flame-stabilizing fuel input rate may maintain or generate robust flames for the furnace system 104 without cycling or restarting the furnace system 104. The flame-stabilizing fuel input rate may be the same or different from the threshold fuel input rate, in some embodiments. Additionally, in some embodiments, the fuel input rate is maintained at the flame-stabilizing fuel input rate for a flame-stabilizing threshold time period. The flame-stabilizing threshold time period may be selected to reduce an amount of excess heat provided to the interior space 119 of the building 10, while ensuring or generating the robust flames. In some embodiments, the flame-stabilizing threshold time period may be set as 1 second, 30 seconds, 60 seconds, 120 seconds, and so forth. However, in some embodiments, the controller 180 may instruct the modulating gas valve 128 to increase the fuel input rate to the flame-stabilizing fuel input rate by instructing the furnace system 104 to cycle through a startup mode.

Further, in response to determining that the fuel input rate is below the threshold fuel input rate for the threshold time period, the controller 180 may instruct the draft inducer blower 154 to increase the exhaust flowrate to a flame-stabilizing exhaust flowrate, as indicated by block 260. The flame-stabilizing exhaust flowrate may be a controller-stored value indicative of an exhaust flowrate that maintains or generates robust flames within the burners 126 of the burner assembly 116. For example, by increasing the speed of the draft inducer blower 154, the negative pressure within the heat exchanger increases and generates a stronger pull on the burner assembly 116, thus providing a pulling force to draw any flashed back flames out of the bodies 208 of the burners 126. In some embodiments, the flame-stabilizing exhaust flowrate may be set as at least 40 percent, 50 percent, 60 percent, 70 percent, 80 percent, 90 percent, 100 percent, and so forth of a maximum exhaust flowrate for the furnace system 104. As such, increasing or ramping the exhaust flowrate to the flame-stabilizing exhaust flowrate may also maintain or generate robust flames for the furnace system 104 without cycling or restarting the furnace system 104. In some embodiments, the exhaust flowrate is maintained at the flame-stabilizing exhaust flowrate for the flame-stabilizing threshold time period, though in other embodiments, an individual flame-stabilizing threshold time period is selected for the exhaust flowrate. For example, a flame-stabilizing threshold time period for the exhaust flowrate may be longer or shorter than a flame-stabilizing threshold time period for the fuel input rate. Moreover, in some embodiments, the controller 180 may instruct the draft inducer blower 154 to increase the exhaust flowrate to the flame-stabilizing exhaust flowrate by instructing the furnace system 104 to cycle through a startup mode.

Additionally, as recognized herein, operating the draft inducer blower 154 at an increased exhaust flowrate may involve providing less additional heating to the interior space 119 of the building 10 as compared to operating the modulating gas valve 128 at an increased fuel input rate. However, the controller 180 may ramp up operation of the draft inducer blower 154 simultaneously with operation of the modulating gas valve 128 to provide rapid adjustment and control to the flames of the burner assembly 116 in some embodiments. Thus, the controller 180 may provide control signals to operate the modulating gas valve 128, the draft inducer blower 154, or both to maintain robust flames of the furnace system 104. In some embodiments, the controller 180 may instruct both the modulating gas valve 128 and the draft inducer blower 154 to operate at their respective flame-stabilizing rates, while in other embodiments, the controller 180 may instruct only one of the modulating gas valve 128 and the draft inducer blower 154 to operate at its respective flame-stabilizing rate.

Moreover, the controller 180 may perform any other suitable control actions in response to determining that the fuel input rate is below the threshold fuel input rate for the threshold time period, such as triggering an alarm, storing a data point indicative of the determination within a database to enable evaluation of the furnace system 104, shutting down the furnace system 104, and so forth. Moreover, in some embodiments, the controller 180 may instruct the furnace system 104 to cycle through a startup mode in response to the determination of block 254.

Figure 8:
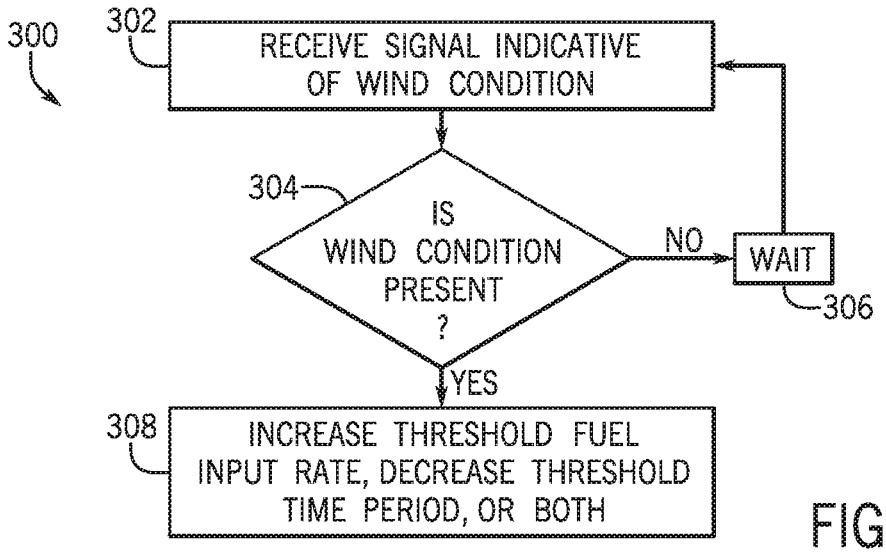
FIG. 8 is a flow chart of an embodiment of a method for adjusting operation of the flame control system of FIG. 5 for wind conditions, in accordance with present techniques.

Additionally, the thresholds stored within the controller 180 for controlling flames of the furnace system 104 may be adjusted based on environmental conditions of the furnace system 104. That is, based on a presence or severity of a wind condition, the controller 180 may increase and/or decrease certain thresholds in some embodiments. By way of an example, FIG. 8 is a flow chart of an embodiment of a method 300 for operating the flame control system 106 to adapt to wind conditions of the HVAC system 100. The method 300 of FIG. 8 is described with reference to the elements of FIGS. 1-7. One or more steps of the method 300 may be performed simultaneously or in a different sequence from the sequence in FIG. 8. The method 300 may be performed by the controller 180 of the furnace system 104 or by another suitable controller communicatively coupled to the flame control system 106 of the furnace system 104. First, as indicated by block 302, the controller 180 may receive a signal indicative of a wind condition near the enclosure 120 of the furnace system 104. For example, the wind sensor 170 may transmit signals to the controller 180 based on a detected pressure or detected wind level or speed near the wind sensor 170, which may be coupled to or disposed within the enclosure 120. The wind sensor 170 may transmit the signals continuously, at regular intervals, in response to a detected change in the wind condition, and so forth.

As indicated by block 304, the controller 180 may then determine whether a wind condition is present. For example, the controller 180 may compare the detected pressure to a threshold pressure in some embodiments to determine whether the wind condition is present. Moreover, in some embodiments, the controller 180 may compare a detected wind speed to a threshold wind speed to determine whether the wind condition is present. In response to determining that the wind condition is not present, the controller 180 may proceed to wait a predetermined amount of time, as indicated by block 306. Then, the controller 180 may return to block 302 to continue receiving signals indicative of the wind condition.

Alternatively, in response to determining that the wind condition is present, the controller 180 may proceed to adjust one or more thresholds employed by the flame control system 106 for maintaining robust flames. For example, as indicated by block 308, the controller 180 may increase the threshold fuel input rate such that the flame control system 106 triggers control actions at higher fuel input rates, decreases the threshold time period such that the flame control system 106 may trigger control actions in response to shorter periods of time at a fuel input rate below the threshold fuel input rate, or both. As such, in response to a detected wind condition, the flame control system 106 may selectively increase its sensitivity to fuel input rates below the threshold fuel input rate, and thus perform control actions more frequently to maintain the robust flames. Then, in response to a subsequent determination that the wind condition is not present, the controller 180 may return the thresholds to default or previous levels. In some embodiments, the controller 180 may escalate or deescalate the thresholds to multiple levels as the wind condition escalates or deescalates.

Accordingly, the present disclosure is directed to a flame control system for maintaining robust flames within burners of a furnace system. A modulating gas valve adjusts a fuel flowrate provided to the burners, and a draft inducer blower adjusts a negative pressure that draws combustion air into the burners and draws hot exhaust gas through a heat exchanger. Thus, the flame control system includes a controller that monitors a fuel input rate provided to the burners via the modulating gas valve. Then, if the fuel input rate indicates the furnace system is ramped down for at least a threshold time period, the controller may instruct the modulating gas valve and/or the draft inducer blower to ramp up the furnace system, thus reestablishing or maintain robust flames for the furnace system. As such, the flame control system operates in an open control loop to modify parameters or operating handles of the furnace system for keeping strong and robust flames therein. By maintaining robust flames for the burners, the flame control system improves an efficiency of the furnace system.

While only certain features and embodiments of the present disclosure have been illustrated and described, many modifications and changes may occur to those skilled in the art, such as variations in sizes, dimensions, structures, shapes and proportions of the various elements, values of parameters, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A furnace, comprising:

a controller configured to instruct a blower of the furnace to temporarily increase an exhaust flowrate of the furnace, instruct a gas regulation device of the furnace to temporarily increase a fuel input rate of the furnace, or both in response to a determination that the fuel input rate is below a threshold fuel input rate for a threshold time period.

2. The furnace of claim 1, wherein the controller is configured to instruct the blower to maintain an increased exhaust flowrate for a flame-stabilizing time period, instruct the gas regulation device to maintain an increased fuel input rate for the flame-stabilizing time period, or both.

3. The furnace of claim 1, wherein the controller is configured to instruct the blower to increase the exhaust flowrate and instruct the gas regulation device to increase the fuel input rate in response to the determination that the fuel input rate is below the threshold fuel input rate for the threshold time period.

4. The furnace of claim 1, wherein the controller is configured to instruct the gas regulation device to increase the fuel input rate in response to the determination, and wherein the controller is configured to cycle the gas regulation device through a startup mode to increase the fuel input rate.

5. The furnace of claim 1, further comprising the blower and the gas regulation device, wherein the blower and the gas regulation device are each communicatively coupled to the controller.

6. The furnace of claim 5, wherein the gas regulation device comprises a gas valve or a pressure regulator, wherein the gas regulation device is configured to provide a fuel to a burner of the furnace, and wherein the blower is configured to draw an exhaust gas through a heat exchanger of the furnace.

7. The furnace of claim 5, wherein the gas regulation device comprises a modulating gas valve, and the furnace comprises a modulating furnace.

8. The furnace of claim 1, wherein the controller is configured to instruct the blower to increase the exhaust flowrate, and wherein the controller is configured to cycle the blower through a startup mode to increase the exhaust flowrate.

9. The furnace of claim 1, further comprising a sensor communicatively coupled to the controller, wherein the sensor is configured to detect an environmental wind condition, and wherein the controller is configured to adjust the threshold fuel input rate in response to the environmental wind condition.

10. The furnace of claim 1, wherein the controller is configured to instruct the blower to increase the exhaust flowrate to a flame-stabilizing exhaust flowrate comprising at least 50 percent of a maximum exhaust flowrate of the furnace in response to the determination.

11. The furnace of claim 1, wherein the threshold fuel input rate comprises less than 50 percent of a maximum fuel input rate of the furnace.

12. The furnace of claim 1, wherein the controller is configured to instruct the gas regulation device to increase the fuel input rate to a flame-stabilizing fuel input rate comprising at least 50 percent of a maximum fuel input rate of the furnace in response to the determination.

13. A furnace, comprising:

a gas regulation device configured to adjust a fuel input rate of the furnace;

a blower configured to adjust an exhaust flowrate of the furnace; and a controller communicatively coupled to the gas regulation device and the blower, wherein the controller is configured to separately instruct the gas regulation device and the blower to temporarily adjust the fuel input rate and the exhaust flowrate, respectively, in response to a determination that the fuel input rate of the furnace is below a threshold fuel input rate for a threshold time period.

14. The furnace of claim 13, wherein the controller is configured to instruct the gas regulation device, instruct the blower, or both, to maintain a flame outside of a body of a burner of the furnace in response to the determination that the fuel input rate is below the threshold fuel input rate for the threshold time period.

15. The furnace of claim 13, wherein the controller is configured to instruct the blower to maintain an adjusted exhaust flowrate for a flame-stabilizing time period, instruct the gas regulation device to maintain an adjusted fuel input rate for the flame-stabilizing time period, or both.

16. The furnace of claim 13, wherein the controller is configured to instruct the blower to maintain an adjusted exhaust flowrate for a first flame-stabilizing time period, instruct the gas regulation device to maintain an adjusted fuel input rate for a second flame-stabilizing time period, or both, wherein the first flame-stabilizing time period is different than the second flame-stabilizing time period.

17. The furnace of claim 13, comprising a burner configured to receive a fuel at the fuel input rate from the gas regulation device and configured to burn the fuel via a flame of the burner to generate an exhaust gas.

18. The furnace of claim 17, comprising a heat exchanger fluidly coupled between the burner and the blower, wherein the blower is configured to draw the exhaust gas through the heat exchanger.

19. The furnace of claim 17, comprising an igniter operatively coupled to the burner, communicatively coupled to the controller, and configured to ignite the fuel of the burner to produce the flame.

20. The furnace of claim 19, comprising a flame sensor operatively coupled to the burner, communicatively coupled to the controller, and configured to detect a presence of the flame, wherein the controller is configured to instruct the igniter to produce the flame in response to a determination that the flame is not present.

21. A method of operating a flame control system for a furnace, comprising:

monitoring a fuel rate of the furnace; and temporarily adjusting the fuel rate to a flame-stabilizing fuel rate in response to a determination that the fuel rate of the furnace is below a threshold fuel rate for a threshold time period .

22. The method of claim 21, wherein adjusting the fuel rate to the flame-stabilizing fuel rate comprises instructing a gas valve to provide a fuel to a burner of the furnace at the flame-stabilizing fuel rate.

23. The method of claim 21, comprising adjusting an exhaust flowrate to a flame-stabilizing exhaust flowrate by instructing a blower to draw an exhaust gas through a heat exchanger of the furnace at the flame-stabilizing exhaust flowrate.

24. The method of claim 23, comprising instructing the furnace to maintain the flame-stabilizing fuel rate, the flame-stabilizing exhaust flowrate, or both, for a flame-stabilizing threshold time period.

25. The method of claim 21, comprising:

monitoring an environmental wind condition; and adjusting the threshold fuel rate, the threshold time period, or both in response to the environmental wind condition.

26. The method of claim 21, wherein the fuel rate comprises a fuel input rate.

27. The method of claim 21, wherein the fuel rate comprises a fuel output rate.

* * * * *